US005787602A

United States Patent [19]

Hsu et al.

[11] Patent Number: 5,787,602

[45] Date of Patent: Aug. 4, 1998

[54] DRYER FABRIC WITH ADHESIVE TACKY SURFACE FOR WEB

[75] Inventors: Chien-Yeh Hsu, Greer; Volker Ostermayer, Greenville, both of S.C.

[73] Assignee: Wangner Systems Corporation, Greenville, S.C.

[21] Appl. No.: 828,651

[22] Filed: Mar. 31, 1997

[51] Int. Cl.[6] ..... D06F 58/00

[52] U.S. Cl. ..... 34/116; 428/153

[58] Field of Search ..... 34/444, 454, 459, 34/462, 116, 117, 118, 120, 123; 162/103, 108, 112, 140; 428/152, 153, 195, 198, 222, 327

[56] References Cited

U.S. PATENT DOCUMENTS

| | | | |
|---|---|---|---|
| 3,175,792 | 3/1965 | Smallian | 245/8 |
| 3,699,663 | 10/1972 | Candor et al. | 34/116 X |
| 4,172,910 | 10/1979 | Rotar | 34/116 X |
| 4,251,928 | 2/1981 | Rotar et al. | 34/116 |
| 4,350,731 | 9/1982 | Siracusano | 428/234 |
| 4,552,620 | 11/1985 | Adams | 162/358 |
| 4,649,964 | 3/1987 | Smith | 34/116 X |
| 5,422,166 | 6/1995 | Fleischer | 428/193 |

*Primary Examiner*—Henry A. Bennett
*Assistant Examiner*—Steve Gravini
*Attorney, Agent, or Firm*—Cort Flint; Henry S. Jaudon

[57] ABSTRACT

A method of controlling a web of paper forming slurry stationary on a dryer fabric during drying in the drying section of a papermaking machine comprising:

forming the dryer fabric of synthetic yarns to be continuous;

positioning the dryer fabric about drying drums of the paper drying machine;

providing the dryer fabric with an adhesive or tacky support surface and delivering the web onto the adhesive support surface for passage through the dryer section;

gripping or securing the web with the adhesive support surface into a relatively fixed and stationary position on the dryer fabric as it is passed about the drums and through the drying section of the paper making machine; and removing the web from the dryer section.

9 Claims, 3 Drawing Sheets

DRYER FABRIC WITH ADHESIVE TACKY SURFACE FOR WEB

BACKGROUND OF THE INVENTION

This invention relates to a method of drying a web of paper forming slurry in the dryer section of a papermaking machine and the structure of the dryer fabric which caries out the method.

The yarns used to form dryer fabrics have evolved to become mostly synthetic continuous mono-filament or multifilament yarns capable of extended wear and having good resistance to degradation due to exposure to the chemicals and high temperatures present during drying in the dryer section of modern papermaking machines. These synthetic continuous filament yarns have a generally common characteristic and that is their outer surface is slick. These poor adhesive characteristics present a problem with the web of paper slurry maintaining its position on the dryer fabric as it is passed about the drying rolls during drying. It has been found that bunching or gathering occurs under certain circumstances and that this bunching or gathering can cause the web to be blotched or creased during drying. In some instances, the web may fall away from the support surface of the dryer fabric causing down time.

Accordingly, it is an object of the present invention to provide a method of maintaining a web of paper slurry in a fixed and stationary position on the dryer fabric during passage through the dryer section of the papermaking machine.

Another object of the invention is the provision of a papermaking dryer fabric having a support surface with superior adhesion characteristics which will function to grip and support the web of paper slurry in a stationary position during drying.

Another object of the invention is to provide a coating with adhesive or tacky properties for the support surface of a dryer fabric which does not alter the desired porosity of the fabric.

Another object of the invention is to provide a coating with adhesive or tacky properties for the support surface of a dryer fabric which does not alter the flexibility of the fabric.

SUMMARY OF THE INVENTION

The above objectives are accomplished according to the present invention is directed to the method of controlling, in the drying section of a papermaking machine, a web of paper forming slurry carried on the support surface of a dryer fabric stationary during drying. The dryer fabric is formed synthetic yarns and is formed continuous.

The method of the invention includes;

forming the dryer fabric by interconnecting successive coils of monofilament yarns or by weaving warp and weft yarns together;

forming the dryer fabric forming yarns of polyethylethlketon and polyphylene sulfide resins as continuous multifilament yarns or continuous monofilament yarns;

forming an adhesive support surface of one of polyurethane, polyacrylic, and polyvinyl chloride resins and applying the resins by forming caps on the upper surfaces of the yarns forming the support surface of a width no greater than the diameter of the coated yarns;

positioning the dryer fabric about drying drums of the paper drying machine and delivering the web onto the adhesive support surface;

allowing the coated support to grip and maintain the web stationary as it is passed through the dryer section; and removing the web from the dryer section;

The invention also includes a dryer fabric for use in the dryer section of a papermaking machine. The dryer fabric includes a support surface for supporting a web of paper forming slurry during drying. The dryer fabric is formed of a plurality of continuous filament warp yarns interwoven with a plurality of continuous filament weft yarns which produce a plurality of knuckles over the support surface. An adhesive coating of synthetic resin is firmly adhered to the knuckle surfaces forming a plurality of caps on upper surfaces of the warp and weft yarns where they cross. Each cap is of a width no greater than the diameter of the yarn to which it is adhered so not to alter the porosity of the dryer fabric. The caps provide adhesive properties capable of maintaining the web stationary on the dryer fabric during drying.

The warp and weft yarns may be monofilament yarns or they may be multifilament yarns. They are preferably formed of at least one of polyethylethlketon and polyurethane sulfide. The synthetic resin forming the caps is preferably one of polyurethane, polyacrylic and polyvinyl chloride.

An alternative arrangement comprises a dryer fabric for use in the dryer section of a papermaking machine formed of a plurality coiled synthetic monofilament yarns arranged side by side and interconnected at adjoining edges with pintles. The synthetic resin caps are secured with the upper surfaces of the coils forming the support surface and again are of a width no greater than the diameter of the coiled yarn. So formed the caps do not alter the desire porosity of the dryer fabric while providing a highly adhesive or tacky support surface capable of maintaining the web stationary during drying.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
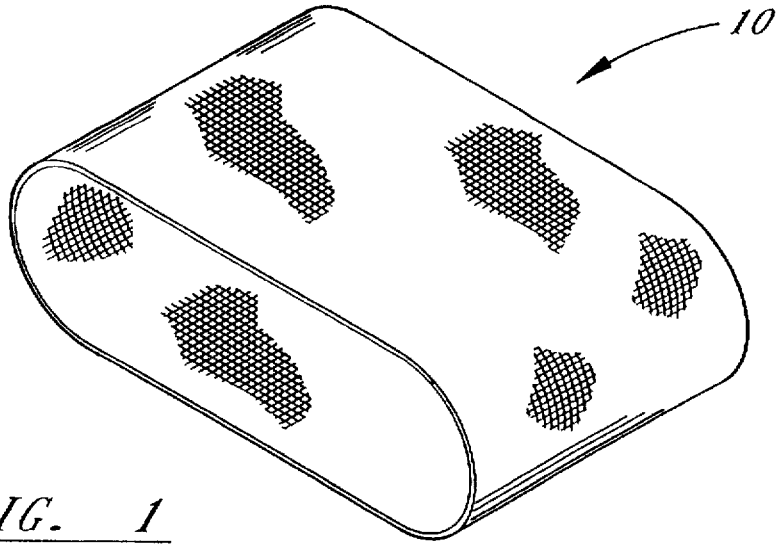
FIG. 1 is a perspective view of a continuous dryer fabric according to the invention.

Turning now to the drawings, FIG. 1 is a schematic view of a generic construction of a continuous dryer fabric identified with the numeral 10.

Figure 2:
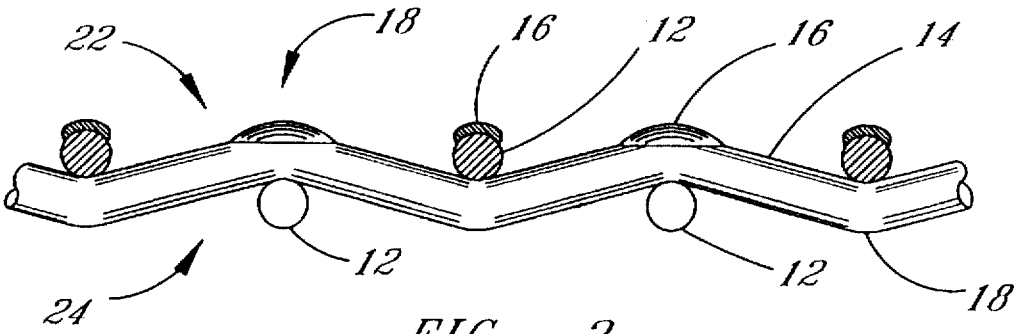
FIG. 2 is a side view of a section of woven dryer fabric having caps of synthetic material adhered to the crossover points of the forming yarns.
Figure 3:
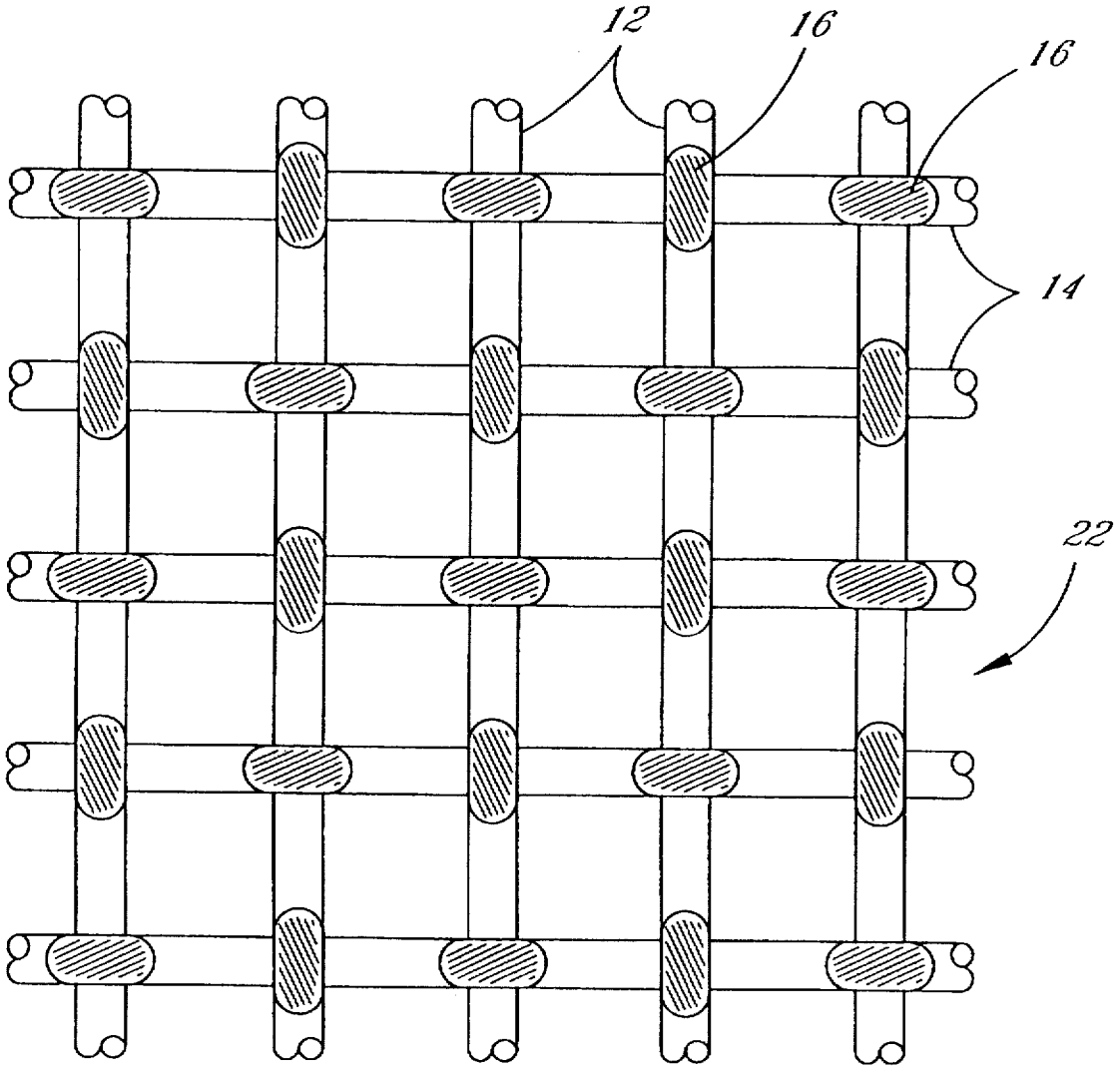
FIG. 3 is a top view of the fabric section shown in FIG. 2.

Dryer fabric 10 may be formed by weaving, an example of which is shown in FIGS. 2 and 3. FIG. 2 shows a side view with warp yarns 12 weaving with weft yarns 14 in any suitable weave pattern. Where the warp and weft yarns cross knuckles 18 are formed on support surface 22 and roller contact surface 24.

Normally, the weft yarns 14 are formed of synthetic material as continuous monofilament yarns although multifilament continuous filament yarns may also be used. Likewise, the warp yarns 12 are normally continuous monofilament yarns with continuous multifilament yarns being an acceptable alternative. Another arrangement could be to form selected of the warp and/or the weft yarns of continuous monofilament yarns and the remainder of continuous multifilament yarns. The warp and weft yarns are preferably formed of polyester, polyethylethlketon, or polyphylene sulfide resins. A blend of these resins would also be suitable as would other materials having suitable wear resistant properties and resistance to degradation due to exposure to the high temperatures and chemicals present in the dryer section of papermaking machines.

Dryer fabric 10 is woven to have a desired permeability, usually between 50% and 80%, and is heat set to retain its structural integrity. This is necessary to provide uniformity over support area 22 which creates uniform marking of the web of paper forming slurry during the drying operation. Also, it prevents shifting of the forming yarns during use which maintains uniform drainage over the fabric.

A characteristic of monofilament yarns formed of the above noted resins is that their outer surface is slick or possesses substantially no abrasion or adhesive characteristics. This does not create a problem for roller contact surface 24, however, this is not true for support surface 22 during some stages of the drying operation.

Figure 5:
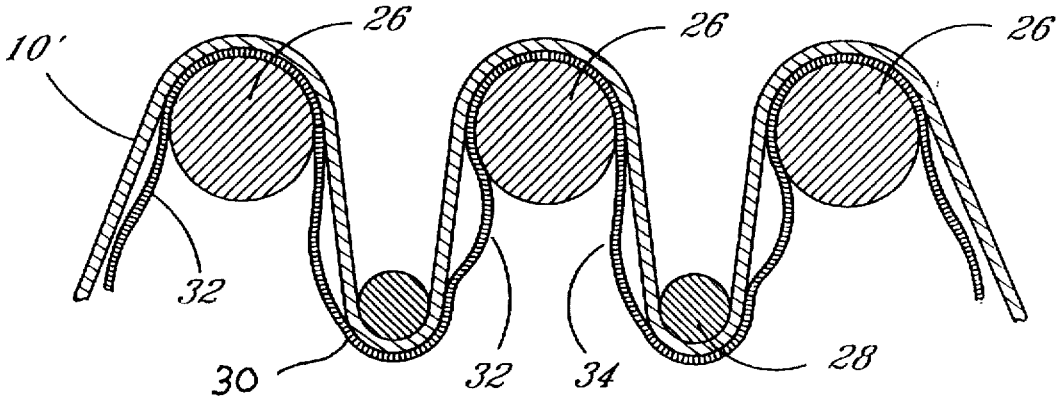
FIG. 5 is a sectional side view of a prior art arrangement showing the web of paper forming slurry disengaging from the dryer fabric during passage through the dryer section.

As shown in FIG. 5, dryer fabric 10', which is formed of usual construction is shown passing over a plurality of drying rolls 26 and guide rolls 28 as it moves through the dryer section. A web 30 of paper forming slurry has been deposited on the support surface of the dryer fabric to be carried between the dryer fabric and dryer rolls 26 and about guide rolls 28 during the drying process. Due to the slick or non-adhesive support surface created by the normal outer texture of the forming yarns, web 30 has a tendency to slip and bunch just prior to being carried beneath dryer fabric 10' and over dryer roll 26. This phenomena is illustrated at 32. Also, after web 30 passes over the dryer drum and is carried toward and around guide roll 28 it has a tendency to fall away from the support surface and gather as indicated at 34. These two phenomena create creases or blotches in the web during drying which produce imperfections in the product. Also, in some instances the web can rupture which causes down time.

To overcome these shortcomings, it has been found that by coating support surface 22 with a synthetic resin which possesses tacky or adhesive characteristics a support surface with the same characteristics is provided. Accordingly, a thin coating of polyurethane, polyacrylic or polyvinyl chloride is adhered to support surface 22, after the dryer fabric has been heat set, forming caps 16 on knuckles 18 of warp and weft yarns 12 and 14. Caps 16 are formed to be no wider than the diameter of warp and weft yarns 12 and 14 thereby not altering the desired porosity formed into the fabric structure. Caps 16 also are limited to the area of knuckles 18 and do not engage with both a warp and weft where they cross. This arrangement allows for the structural and physical integrity of the fabric to be re-altered.

Figure 6:
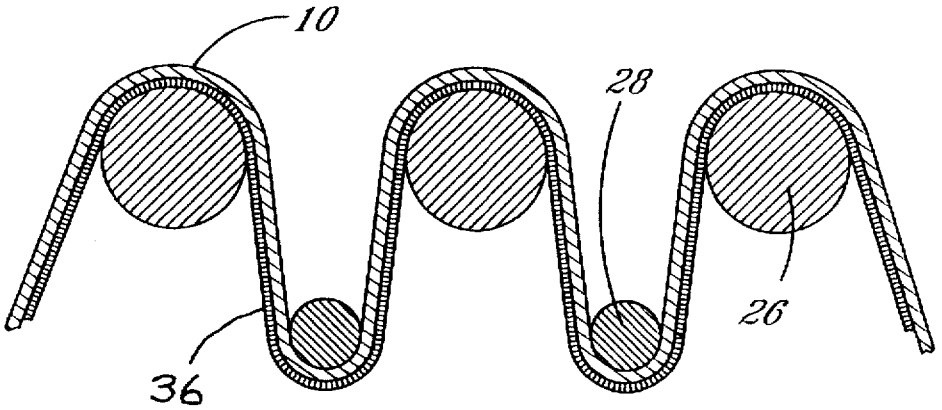
FIG. 6 is a sectional side view of the web of paper forming slurry being secured with the dryer fabric of the invention during drying.

FIG. 6 shows dryer fabric 10 passing through the dryer section of a papermaking machine with web 36 of paper forming slurry held snugly against support surface 22 due to the adhesive or tacky properties of caps 16. As can be seen there is no bunching or falling away and the web passes smoothly and evenly over drying drums 26 and about guide rolls 28. After drying, web 36 is removed from the dryer fabric to continue processing through the papermaking machine in usual manner.

Figure 4:
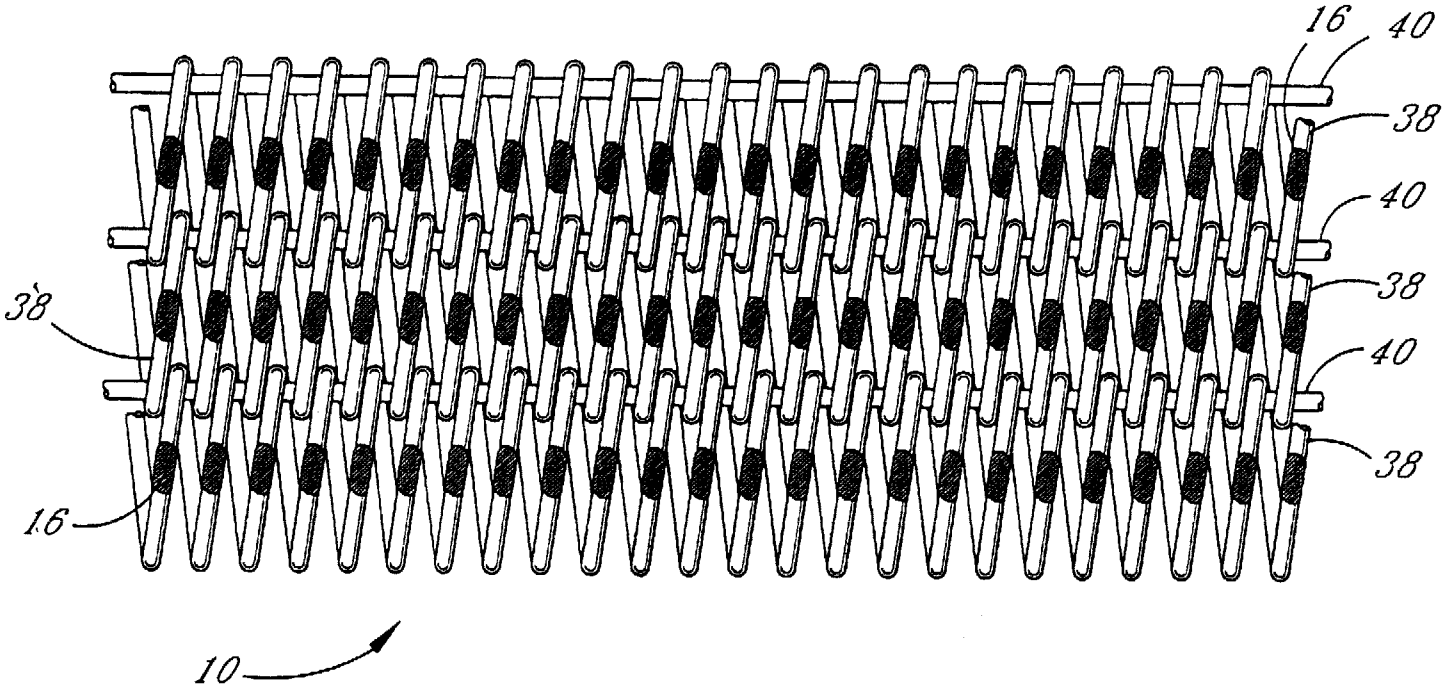
FIG. 4 is a perspective view of an alternative arrangement of the dryer fabric in which coiled yarns are used.

An alternative arrangement is shown in FIG. 4. Here dryer fabric 10 is formed by arranging a plurality of coils 38 with there edges overlapping so that pintles 40 may be inserted to inter-engage the coils into a continuous dryer fabric. As before, dryer fabric 10 formed of interconnected coils, is formed to a desired porosity and is heat set for stability. Coils 38 and pintles 40 are formed of continuous monofilaments of polyester, polyethylethlketon or polyphylene sulfide or other suitable synthetic resins. Again, in order to provide a support surface with desired adhesive or tacky properties a coating of polyurethane, polyacrylic or polyvinyl chloride in the form of caps 16, is adhered to the upper surfaces of coils forming yarns 38. Again, caps 16 are formed of a width no greater than the diameter of yarns 38 so as to not alter the desired porosity of the dryer fabric.

It has been found to be undesirable to coat or encase the entire surface of the forming yarns which would provide a coating over the running surface, in the inter sties of the fabric and at the crossing points of the forming yarns. Besides adding an increased cost of manufacturing, the coating could effect the structural characteristics of the fabric. Also, the coating would need to possess extended wear qualities.

In use, the dryer fabric of FIG. 4 functions in the manner shown and described in FIG. 6.

While a preferred embodiment of the invention has been described using specific terms, such description is for illustrative purposes only, and it is to be understood that changes and variations may be made without departing from the spirit or scope of the following claims.

What is claimed is:

1. A dryer fabric for use in the dryer section of a papermaking machine having a support surface for supporting a web of paper forming slurry during drying and a roll contact surface comprising;

a plurality of continuous filament warp yarns interwoven with a plurality of continuous filament weft yarns forming a plurality of knuckles over said support surface and contact surface;

an adhesive coating of synthetic resin firmly adhered to said knuckle surfaces of said support surface, said coating forming caps on the upper surfaces of said warp and weft yarns where they cross, each said cap having a width no greater than the diameter of the yarn to which it is adhered so not to alter the porosity of said dryer fabric; whereby, said support surface of said dryer fabric comprises adhesive or tacky properties capable of maintaining said web stationary on said dryer fabric during drying.

2. The fabric of claim 1 wherein said warp and weft yarns are monofilament yarns.

3. The fabric of claim 1 wherein said warp and weft yarns are multifilament yarns.

4. The fabric of claim 1 wherein said warp and weft yarns are formed of at least one of polyester, polyethylethlketon and polyurethane sulfide.

5. The fabric of claim 1 wherein said synthetic resin consist of a least one of polyurethane, polyacrylic and polyvinyl chloride.

6. A dryer fabric for use in the dryer section of a papermaking machine having a support surface for supporting a web paper forming slurry during drying and a roller contact surface comprising;

a plurality coiled synthetic monofilament yarns arranged side by side and interconnected at adjoining edges with pintles, caps, formed of an adhesive synthetic resin, secured with upper surfaces of said coils forming said support surface, said caps being of a width no greater than the diameter of said coiled yarn so not to alter the desired porosity of said dryer fabric; whereby, said support surface is formed with a high degree of adhesion capable of maintaining said web stationary thereon during drying.

7. The fabric of claim 6 wherein said synthetic resin is one of polyurethane, polyacrylic and polyvinyl chloride.

8. The fabric of claim 6 wherein said synthetic monofilament yarns are formed of one of polyester, polyethylethlketon and polyphyleve sulfide.

9. The fabric of claim 6 wherein said caps are of a width less than the diameter of said coiled yarns.

* * * * *